US006366189B1

(12) United States Patent
Bergvall et al.

(10) Patent No.: US 6,366,189 B1
(45) **Date of Patent: *Apr. 2, 2002**

(54) SOLENOID

(75) Inventors: Bengt-Allan Bergvall, Huskvarna; Ulf Petersson, Tollered, both of (SE)

(73) Assignee: Aktiebolaget Electrolux, Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/091,680

(22) PCT Filed: Dec. 18, 1996

(86) PCT No.: PCT/SE96/01732

§ 371 Date: Nov. 5, 1998

§ 102(e) Date: Nov. 5, 1998

(87) PCT Pub. No.: WO97/23885

PCT Pub. Date: Jul. 3, 1997

(30) Foreign Application Priority Data

Dec. 22, 1999 (SE) ..... 9504639

(51) Int. Cl.[7] ..... H01F 3/00; H01F 7/08

(52) U.S. Cl. ..... 335/256; 335/229; 335/230; 335/234; 335/255; 335/266

(58) Field of Search ..... 335/179, 229–234, 335/256, 266; 251/129.09, 129.1, 129.15; 310/15, 23, 30, 34; 239/585.1–585.5

(56) References Cited

U.S. PATENT DOCUMENTS 3,202,886 A * 8/1965 Kramer ..... 335/234
4,422,060 A 12/1983 Matsumoto et al. ..... 335/256
5,434,549 A * 7/1995 Hirabayashi et al. ..... 335/229
5,611,370 A * 3/1997 Najmolhoda ..... 137/625.61

FOREIGN PATENT DOCUMENTS

| | | |
|---|---|---|
| DE | 3426688 | 11/1998 |
| DE | 4040120 | 11/1998 |
| GB | 1136418 | 12/1968 |
| GB | 1228539 | 4/1971 |
| GB | 222831 A | 5/1990 |
| JP | 57198611 | 11/1998 |

* cited by examiner

*Primary Examiner*—Ramon M. Barrera
(74) *Attorney, Agent, or Firm*—Pearne & Gordon LLP

(57) ABSTRACT

A solenoid (1) comprising at least two stationary coils (2, 3), which are located axially beside each other and are current supplied at the same time, and at least one magnetically active element (4, 5), such as a permanent magnet or a soft iron part. The solenoid contains one inner and one outer magnetically active element (4, 5), of which at least one is composed of an essentially axially magnetized permanent magnet (4, 5). The coils are located between the elements (4, 5), so that they surround the inner element (4), and are arranged with mutually different current direction, and the coils and the elements (4, 5) are arranged around an essentially mutual axis center line (6), so that a magnetic field is obtained between the elements (4, 5) and this crosses the current supplied coils' (2, 3) wire essentially perpendicularly and gives rise to an axial power action between the coils and the elements, and at least one of the elements is axially movable.

9 Claims, 1 Drawing Sheet

SOLENOID

BACKGROUND OF THE INVENTION

The subject invention refers to a solenoid, comprising at least two stationary coils, which are located axially beside each other and are current supplied at the same time, and at least one magnetically active element, such as a permanent magnet or a soft iron part.

Solenoid devices have many different fields of application. They can for instance switch over circuit-breakers or valves. One example of an utmost demanding application is to be used as a fuel valve in a fuel-supply system for an internal combustion engine. The present invention is based on such an application. The valve shall be able to open and close with a frequency of up to 300 Hz, at the same time as its consumption of energy must be low. In the current absence state the valve shall be open, i.e. it shall have one opening position only. Obviously it should also have a simple, cheap, dependable construction.

It is very difficult for a conventional solenoid with a winding and parts of soft iron to fulfill, the outlined claims. It has great inertia, both electrically, by high inductance, and mechanically. Further it has many parts and is relatively complicated GB 1228539 and GB 2228831 show solenoids having two coils located axially beside each other. But these coils are used alternately and therefore no higher power than for the conventional solenoid can be achieved. It is also known to use a movable permanent magnet, which is driven by means of two surrounding and at the same time current supplied coils. The coils are surrounded longitudinally and radially outwards by soft iron parts, which direct the magnetic flow. The coils have opposite current direction, so that they form a mutual pole in the soft iron part, which separates them. These solenoids have a relatively complicated construction since they have soft iron lids in both ends and a soft iron ring in the middle in order to direct the magnetic flow.

GB 1136418, DE 3426688, JP 57-198.611 show examples of this type of solenoids, which have two holding positions when they are not supplied with power. U.S. Pat. No. 4,422,060 shows a solenoid with a holding position. All those have a light-weight permanent magnet, but a complicated magnetic frame, which closes the magnetic flow.

DE 4040120 shows a permanent magnet surrounded by one or two coils. These coils are not at all surrounded by any soft iron parts. The description is very brief, e.& nothing is mentioned about current direction in the coils or how the permanent magnet's poles are placed. The coils are placed in a relatively large distance from each other. The tuning of the length of the permanent magnet and the coils' mutual distance is such that one of the ends of the permanent magnet is located in an "explosive point" and the other one in an "implosive point". The description is brief and "phenomen-accentuated". It seems that the coils have the same current direction and such a large mutual distance, so that their power action on the permanant magnet can be able to cooperate.

SUMMARY OF THE INVENTION

The purpose of the subject invention is to essentially reduce the above outlined problems.

The above mentioned purpose is achieved in a solenoid, according to the invention, having one inner and one outer magnetically active element, of which at least one is composed of an essentially axially magnetized permanent magnet, and the coils are located between the elements, so that they surround the inner element, and are arranged with mutually different current direction, and the coils and the elements are arranged around an essentially mutual axial centre line, so that a magnetic field is obtained between the elements and this crosses the current supplied coils' wire essentially perpendicularly and gives rise to an axial power action between the coils and the elements and at least one of the elements is axially movable. Consequently, the two coils are not surrounded in anal direction by any soft iron parts, which direct the magnetic flow between one inner and one outer magnetically active element. The flow crosses instead the current supplied coils' wire essentially perpendicularly. Accordingly, by means of this the way of function differs from the majority of known solutions. The magnetic field flows between one outer and one inner magnetically active element, which definitely separates the present invention from DE 4040120, just like the mutually different current direction of the coils. This construction leads to a simple design with very good performance. As the magnetic flow is passing essentially radially between one inner and one outer magnetic element a very good power action is created between magnetic elements and winding As the coils have mutually different current direction the inductance of the solenoid becomes extremely low. This contributes to high rapidity and low consumption. These and other characteristic features and advantages will become more apparent from the detailed description of various embodiments with the support of the appended drawing.

BRIEF DESCRIPTION OF THE DRAWINGS

The invention will be described in closer detail by means of various embodiments with reference to the accompanying drawing.

DESCRIPTION OF PREFERRED EMBODIMENTS

Figure 1:
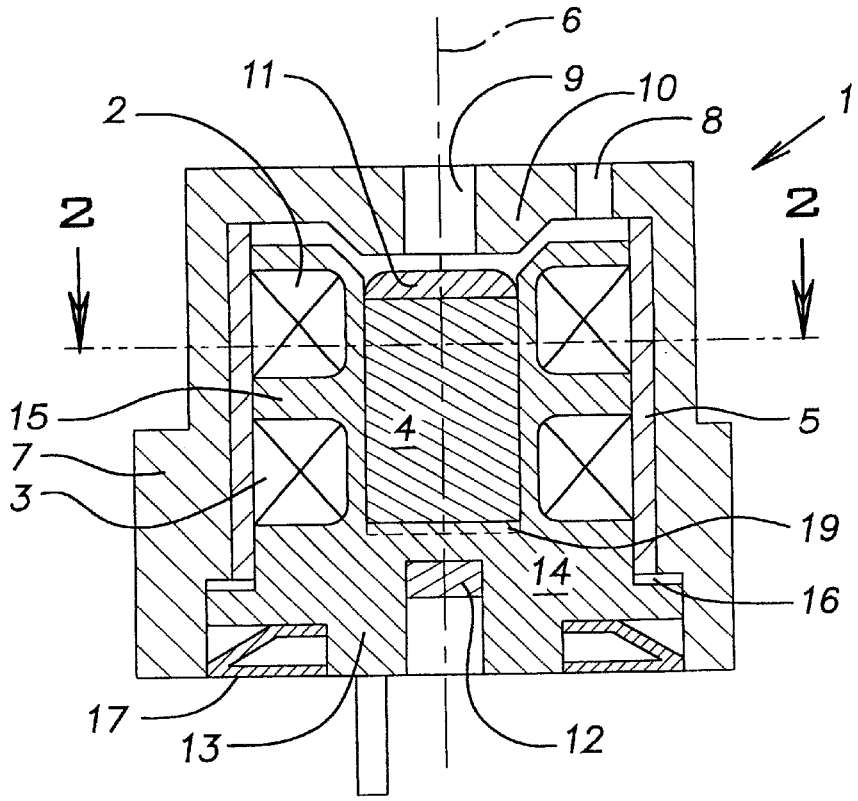
FIG. 1 is a cross-sectional view of a solenoid in accordance with the invention. Its permanent magnet is located in the middle of the solenoid and axially movable, in this case vertically.

In the schematical FIG. 1 numeral reference 1 designates a solenoid Its parts are essentially concentrically arranged around an axial centre line 6. Two coils 2, 3 are located axially beside each other and are arranged around the centre line 6. They are wound in separate recesses in a coil former 14. The coils are arranged with mutually different current direction. The easiest way to achieve this is to have different winding direction for the coils 2, 3 respectively. The winding wire is then running over the intermediate portion 15, which delimits the both coils. But of course, respective coil can also be individually electrically connected, provided that mutually different current direction is attained. In the middle of the coil former 14 there is a recess, where one 4 is so arranged that it is axially easy movable. In the shown embodiment the inner element 4 is an essentially axially magnetized permanent magnet, but it could also be composed of a soft iron part or similar. An axially magnetized permanent magnet has the advantage of being very lightweight. Considering that high rapidity is necessary this is of course an advantage. By axially magnetized is meant that it is so magnetized that at its one end, seen from an axial direction, there is a north pole, while at its other end, there is a south pole. The coil former 14 is made of a non-magnetic material, usually a plastic material and is arranged with guides for the inner element 4. The coil former 14 with the two coils 2 and 3 is surrounded by an outer magnetically activated element 5. In this case it is a soft iron sleeve or similar. Outer and inner elements 5, 4 as also the coils 2, 2 are usually circular, and coaxially arranged around a center line 6. But obviously they could also have another shape.

In the shown embodiment only the inner element 4 is axially movable. Generally this is preferable, but other embodiments can also be conceivable. The outer element 5 can be anally movable alone, or, both the outer and inner element can be axially movable. In the latter case both elements 4, 5 are preferably combined at one of their ends, in this case the upper end. Another example of embodiment is that the outer element 5 is composed of an axially magnetized permanent magnet, while the inner one is composed of a soft iron body or similar. Further both elements 4, 5 can be composed of anally magnetized permanent magnets with mutually reversed magnetization direction In the above examples the outer or the inner element or both elements can be axially movable. In those cases when the elements 4, 5 are composed of a soft iron part and a permanent magnet, the lengths are preferably chosen according to the following That of the elements 4, 5, which is composed of a soft iron part or similar, shall at least have as large axial length as the total axial length of the coils 2, 3. This length is in its turn at least as large as the length of the element, 4, 5, which is composed of a permanent magnet. Normally these differences in length are small.

Figure 2:
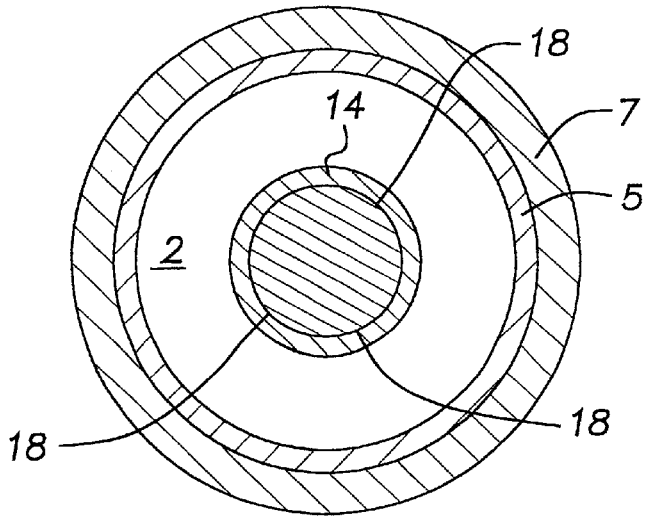
FIG. 2 shows a cross-section of a cut along line II—II in FIG. 1.

FIG. 1 shows an embodiment where the solenoid is adapted to function as a stop valve for a fuel flow. The coils 2, 3 and the elements 4, 5 are enclosed by a housing 7, 13. The housing 7 has a cylindrical opening in which the elements 4, 5 and the coil former 14, together with the coils 2, 3, are inserted In this case the coil former 14 has an end wall. 13, which completely seals the opening in the housing 7. Obviously also other kind of enclosures could be conceivable. A washer 16 is located between the-end of the outer element 5 and a projecting flange at the coil former 14. Obviously this washer could be excluded. A special locking washer 7 is holding the coil former 14 in an axial direction relative to the housing 7. A number of inlet openings 8 and outlet openings 9 are formed in the housing 7 and located in such a manner that at least either the inlet openings or the outlet openings are sealed by the inner. element 4 or. the outer element 5, when this is to be found in an end position. In the shown example the outlet opening 9 is sealed by the inner element 4 when this has been moved to its opposite end position. The outlet opening 9 is thus located in the end wall 10 of the housing and is sealed by the inner element 4, when this is to be found in its end position towards the end wall 10. Obviously, on the other hand the inlet opening 8 could have this location. A sealing 11 is located on the inner element 4 in order to seal between the element and the end wall. Obviously the sealing 11 could also be located on the end wall and have an aperture for the opening 9. In FIG. 2 is shown that a number of recesses 18 are formed in the internal surface of the coil former 14 turned against the inner element 4. These recesses makes a fuel circulation possible around the inner element 4 when this is moving A recess 19 in the internal edge of end wall 13 of the coil former 14 associates to the recesses 18. By means of these recesses 18, 19 the inner element will not be slowed down when moving. Obviously the recesses 18, 19 can be made larger than those shown. A pin may be used for electrical connection of the two coils 2, 3.

In the shown position of the inner element 4 fuel can flow between inlet opening 8 and outlet opening 9. The inner element 4 is kept in this position by means of a soft iron part 12, or similar, being located in the end wall 13. The element is thus kept in this position without any need of current to the coils. In the present application this means both an energy-saving and an increased reliability compared with the case that a special holding current should be added to the coils 2, 3, in order to keep the inner element 4 in its lower position, which allows the fuel to pass through the openings 8 and 9. For blocking the thoroughfare of fuel a very strong location altering current is supplied, making the element 4 go fast up to the end wall 10. Thereafter a weaker holding upwards current is supplied in order to maintain a sealing against the end wall 10. This holding current is approximately only a fifth of the size of the location altering current. In order to open the fuel supply rapidly a strong location altering current is supplied in the opposite direction to the earlier one, i.e. for a movement downwards. No holding current is needed since the soft iron part 12 is located in the end wall 13 opposite the end wall 10 with the openings 8, 9. In a further application a soft iron part 12 could be located in the end wall 10 in order to provide a valve normally closed. Obviously also soft iron parts could be used in both end walls 10, 13.

What is claimed is:

1. A solenoid (1) comprising:

a coil assembly consisting of two stationary coils (2, 3), which are located axially beside each other and are current supplied at the same time, and magnetically-active inner and outer elements of which at least one is composed of a single essentially axially magnetized permanent magnet (4, 5), wherein the coils are located between the inner and outer elements (4, 5), so that they surround the inner element (4), and are arranged with mutually different current directions, and the coils and the inner and outer elements (4, 5) are arranged around an essentially mutual axial center line (6), so that a magnetic field is obtained between the inner and outer elements (4, 5), said magnetic field crosses the current supplied coils essentially perpendicularly to wires defining the coils and gives rise to an axial power action between the coils and the inner and outer elements, wherein at least one of the inner and outer elements is axially movable.

2. A solenoid (1) according to claim 1 wherein only the inner element is axially movable.

3. A solenoid according to claim 1, wherein the outer element is composed of the axially magnetized permanent magnet, while the inner element is composed of a soft iron sleeve.

4. A solenoid (1) according to claim 1 wherein the inner element is composed of the axially magnetized permanent magnet and the outer element is composed of another axially magnetized permanent magnet.

5. A solenoid according to claim 1, wherein the inner element is composed of the axially magnetized permanent magnet, while the outer element is composed of a soft iron sleeve.

6. A solinoid (1) according to claim 5 wherein the outer element has an axial length at least as large as the total length of the coils. which in turn, is at least as large as the length of the inner element.

7. A solinoid (1) according to claim 1 further comprising:

a housing at least partially enclosing the coils and the inner and outer elements. said housing having an inlet opening and an outlet opening formed therein. said inlet and outlet openings being located such that at least one of the inlet and outlet openings is closed by said axially-movable one of the inner and outer elements when said axially-movable one of the inner and outer elements is in an end position.

8. A solinoid (1) according to claim 7. wherein the housing comprises an end wall through which said one of the inlet and outlet openings extends.

9. A solenoid (1) according to claim 8, wherein said axially-movable one of the inner and outer elements is the inner element. and wherein the solenoid further comprises a sealing (11) disposed on at least one of the inner element (4) and the end wall (10), in order to seal between the inner element and the end wall.

* * * * *

UNITED STATES PATENT AND TRADEMARK OFFICE

CERTIFICATE OF CORRECTION

PATENT NO. : 6,366,189 B1 
DATED : April 2, 2002
INVENTOR(S) : Bengt-Allan Bergvall and Ulf Petersson It is certified that error appears in the above-identified patent and that said Letters Patent is hereby corrected as shown below:

Title page,
Item [30], Foreign Application Priority Data, please delete "December 22, 1999", and insert therefor -- December 22, 1995 --.

Item [56], References Cited, FOREIGN PATENT DOCUMENTS, please delete
"GB 222831 A 5/1990", and insert therefor
-- GB 2228831 A 5/1990 --.

Column 1,
Line 50, please delete "e.&", and insert therefor -- e.g. --.

Column 2,
Line 15, please delete "anal", and insert therefor -- axial --.
Lines 50 and 51, please delete "DESCRIPTION OF PREFERRED EMBODIMENTS", and insert therefor -- DETAILED DESCRIPTION OF THE PREFERRED EMBODIMENTS --.
Line 54, after "solenoid", please insert therefor -- . -- (period).
Line 65, after "one", please insert therefor -- inner magnetically active element --.

Column 3,
Line 15, please delete "2, 2", and insert therefor -- 2, 3 --.
Line 30, please delete "anally", and insert therefor -- axially --.
Line 55, please delete "7", and insert therefor -- 17 --.
Line 59, after "or", please delete -- . -- (period).

Column 4,
Line 8, after "moving", please insert therefor -- . -- (period).

UNITED STATES PATENT AND TRADEMARK OFFICE

CERTIFICATE OF CORRECTION

PATENT NO. : 6,366,189 B1
DATED : April 2, 2002
INVENTOR(S) : Bengt-Allan Bergvall and Ulf Petersson It is certified that error appears in the above-identified patent and that said Letters Patent is hereby corrected as shown below:

Column 5,
Line 8, after "sleeve" and before "." (period), please insert therefor -- and the end element is composed of soft iron --.

Signed and Sealed this

Seventeenth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,366,189 B1
DATED : April 2, 2002
INVENTOR(S) : Bergvall et al.

It is certified that error appears in the above-identified patent and that said Letters Patent is hereby corrected as shown below:

Title page,
Item [*] Notice, "Subject to any disclaimer, the term of this patent is extended or adjusted under 35 USC 154(b) by (0) days", delete the phrase "by 0 days" and insert -- by 103 days --

Signed and Sealed this

Fourteenth Day of October, 2003

JAMES E. ROGAN
*Director of the United States Patent and Trademark Office*